US007632193B2

(12) United States Patent
Thielen

(10) Patent No.: US 7,632,193 B2
(45) Date of Patent: Dec. 15, 2009

(54) GOLF CLUB

(75) Inventor: Klaus Thielen, Schönau am Königssee (DE)

(73) Assignee: Thielen Feinmechanik GmbH & Co. Fertigungs KG (DE)

( * ) Notice: Subject to any disclaimer, the term of this patent is extended or adjusted under 35 U.S.C. 154(b) by 408 days.

(21) Appl. No.: 11/463,512

(22) Filed: Aug. 9, 2006

(65) Prior Publication Data

US 2007/0037633 A1 Feb. 15, 2007

(30) Foreign Application Priority Data

Aug. 10, 2005 (DE) ..... 10 2005 037 857

(51) Int. Cl.
*A63B 53/04* (2006.01)

(52) U.S. Cl. ..... 473/334; 473/345; 473/346; 473/349

(58) Field of Classification Search ..... 473/324–350, 473/256

See application file for complete search history.

(56) References Cited

U.S. PATENT DOCUMENTS

| | | | | | |
|---|---|---|---|---|---|
| 1,133,129 | A * | 3/1915 | Govan | 473/337 |
| 1,840,924 | A * | 1/1932 | Tucker | 473/337 |
| 3,606,327 | A * | 9/1971 | Gorman | 473/297 |
| 4,076,254 | A * | 2/1978 | Nygren | 473/337 |
| 4,811,950 | A * | 3/1989 | Kobayashi | 473/335 |
| 5,344,151 | A * | 9/1994 | Anderson et al. | 473/337 |
| 5,397,126 | A * | 3/1995 | Allen | 473/324 |
| 5,570,886 | A * | 11/1996 | Rigal et al. | 473/345 |
| 5,839,975 | A * | 11/1998 | Lundberg | 473/346 |
| 5,888,148 | A * | 3/1999 | Allen | 473/290 |
| 5,947,840 | A * | 9/1999 | Ryan | 473/335 |
| 6,319,148 | B1 * | 11/2001 | Tom | 473/290 |
| 6,558,271 | B1 * | 5/2003 | Beach et al. | 473/327 |
| 2003/0036441 | A1 | 2/2003 | Vincent et al. | |
| 2003/0153401 | A1 | 8/2003 | Helmstetter et al. | |

FOREIGN PATENT DOCUMENTS

| | | | |
|---|---|---|---|
| GB | 2 407 781 | A | 5/2005 |
| WO | 01/08757 | A2 | 2/2001 |
| WO | 2004/007033 | A1 | 1/2004 |
| WO | 2004/071588 | A2 | 8/2004 |

OTHER PUBLICATIONS

Corresponding German Patent Application No. 10 2005 037 857.9, German Search Report, dated Apr. 4, 2006, 4 pages.
English translation of Corresponding German Patent Application No. 10 2005 037 857.9, German Search Report, dated Apr. 4, 2006, 4 pages.

* cited by examiner

*Primary Examiner*—Sebastiano Passaniti
(74) *Attorney, Agent, or Firm*—Lewis and Roca LLP

(57) ABSTRACT

A golf club is described having a club head which is fastened to a club shaft end and whose striking plate is connected at an edge side to a main body, with the main body made as a hollow body having a receiver and fixing for a central weight disposed opposite and centered with respect to the striking plate.

20 Claims, 2 Drawing Sheets

GOLF CLUB

CROSS-REFERENCE TO RELATED APPLICATIONS

Figure 1:
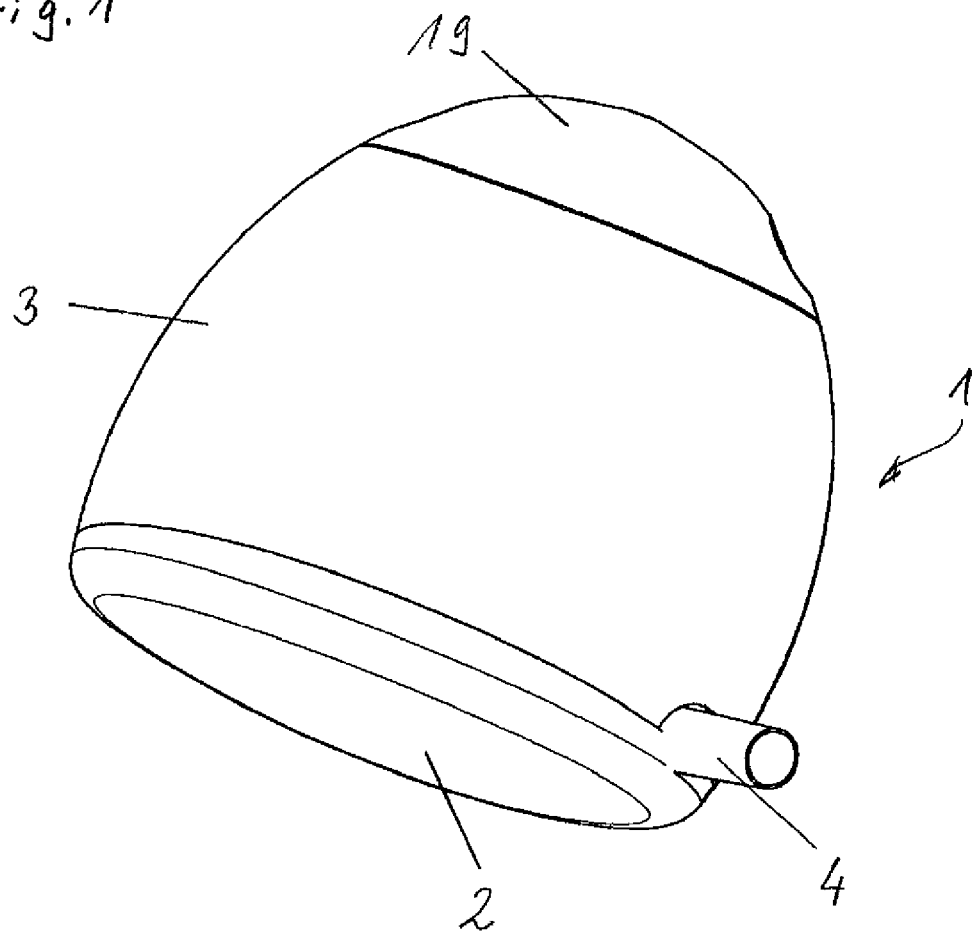

This application claims the benefit of German Patent Application No. 10 2005 037 857.9, filed Aug. 10, 2005. The disclosure of the above application is incorporated herein by reference as if set forth herewith.

FIELD

The invention relates to a golf club having a club head which is fastened to a club shaft end and whose striking plate is connected at the edge side to a main body made in an aerodynamic dome shape.

BACKGROUND

The statements in this section merely provide background information related to the present disclosure and may not constitute prior art.

In the area of the development and design of golf clubs, in particular of the golf clubs known as "woods", those skilled in the art are constantly striving to improve both directional accuracy and achievable distance of the shots by the clubs. Clubs with a low angle of inclination of the striking plate, in particular drivers, are particularly critical with respect to directional accuracy.

For the individual adaptation of the swing weights of golf clubs, it is known to design clubs such that removable weights can be connected, in particular can be screwed, to the club head to increase or decrease weight of the club head.

Since it is difficult for the average golfer to consistently hit the ball in the ideal location or "sweet spot" of the club, i.e. at the center of the striking plate and with a striking plate aligned transversely to the target direction, those skilled in the art attempt to design golf clubs with club head structures that reduce the negative effects of on the accuracy of the direction of flight and the distance of flight caused by not hitting the ball with the "sweet spot" of the club head.

SUMMARY

It is the object of the present invention to design a golf club of the initially named kind such that high shot distances and a high directional accuracy can be achieved, as well as adaptation of the club to an individual user.

This object is satisfied in accordance with the invention substantially in that a receiver is provided in a hollow main body disposed opposite the striking plate. The receiver is configured to receive a central weight, which is positioned in the receiver at least substantially centrally in the axial projection with respective to the striking plate.

A club head that forgives stroke errors is provided due to this special construction. The club head construction also provides more directional accuracy. These advantages are a consequence of the interaction between the striking plate and main body. The striking plate is preferably made particularly stiff with respect to bending of a club shaft. The main body is preferably made as a hollow body and likewise stiff with respect to bending the shaft. This allows the weight of the club head to move from the striking plate structure and the main body structure into the rear part of the club head in the form of an additional weight. An optimum interaction between the striking plate, the hollow body and the central weight results in this manner with respect to the desired club head properties.

It is of significance in this connection to deliberately select the central weight centered with respect to the striking plate. The weight of this central weight preferably being selected to be in a range from approximately one third of the weight of the striking plate to about two thirds of the striking plate, and preferably being greater than the weight of a golf ball.

A preferred embodiment of the invention is characterized in that the main body is made as a hollow body, which is spaced apart and is opposite to the striking plate. The main body also has a support surface, which has at least one receiver for the centering of a central weight. The central weight is positioned at least substantially centrally in the axial projection with respect to the striking plate.

The main body, which is aerodynamically shaped and accordingly has a low drag, is covered at the rear by a cover part, which can be screwed to the main body. The support surface is accessible through the cover part for the fitting with the respectively desired central weight and, optionally, with further balance weights.

The striking plate is preferably provided at the rear with integral stiffening contours or bead patterns. In particular, a stiffening contour that is analog to a honeycomb pattern is provided for achieving a high bending strength. In this manner, the high bending strength can be achieved with a simultaneous optimum weight saving.

The hollow body forming the main body can be made of plastic, a plastic reinforced with carbon fibers, metal, and any combination thereof. Preferably the hollow body is made of a composite of metal and plastic or plastic reinforced with carbon fibers. In all cases, this hollow body is substantially made stiff with respect to bending and it can consist of or comprise a plurality of mutually spaced apart flat braces that are curved in accordance with the contour of the main body at least in a region of its extent between the striking plate and the support surface.

The support surface is preferably made of hardened steel, with the already mentioned flat braces likewise being made of hardened steel. The braces are preferably able to be shaped directly on the support surface so that practically a type of steel spider is created, which is jacketed with plastic for the completion of the club head or can have a jacket of plastic reinforced with carbon fibers. The support surface itself is made stiff with respect to bending. For this purpose, the support surface includes bead patterns with an ideally dimensioned thickness for the purpose of weight saving.

In addition to the receiver that is provided in the support surface for different central weights and in addition to the bead patterns formed in this support surface, receivers can also be provided in this support surface for a plurality of balance weights, in particular four balance weights.

These balance weights, which are radially spaced apart with respect to the central weight in the support surface and are positioned around the central weight, permit an individual matching of the club head to the respective user. In this manner, slice tendencies, which may be present, are countered in a user's swing by a suitable choice and positioning of balance weights.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 2:
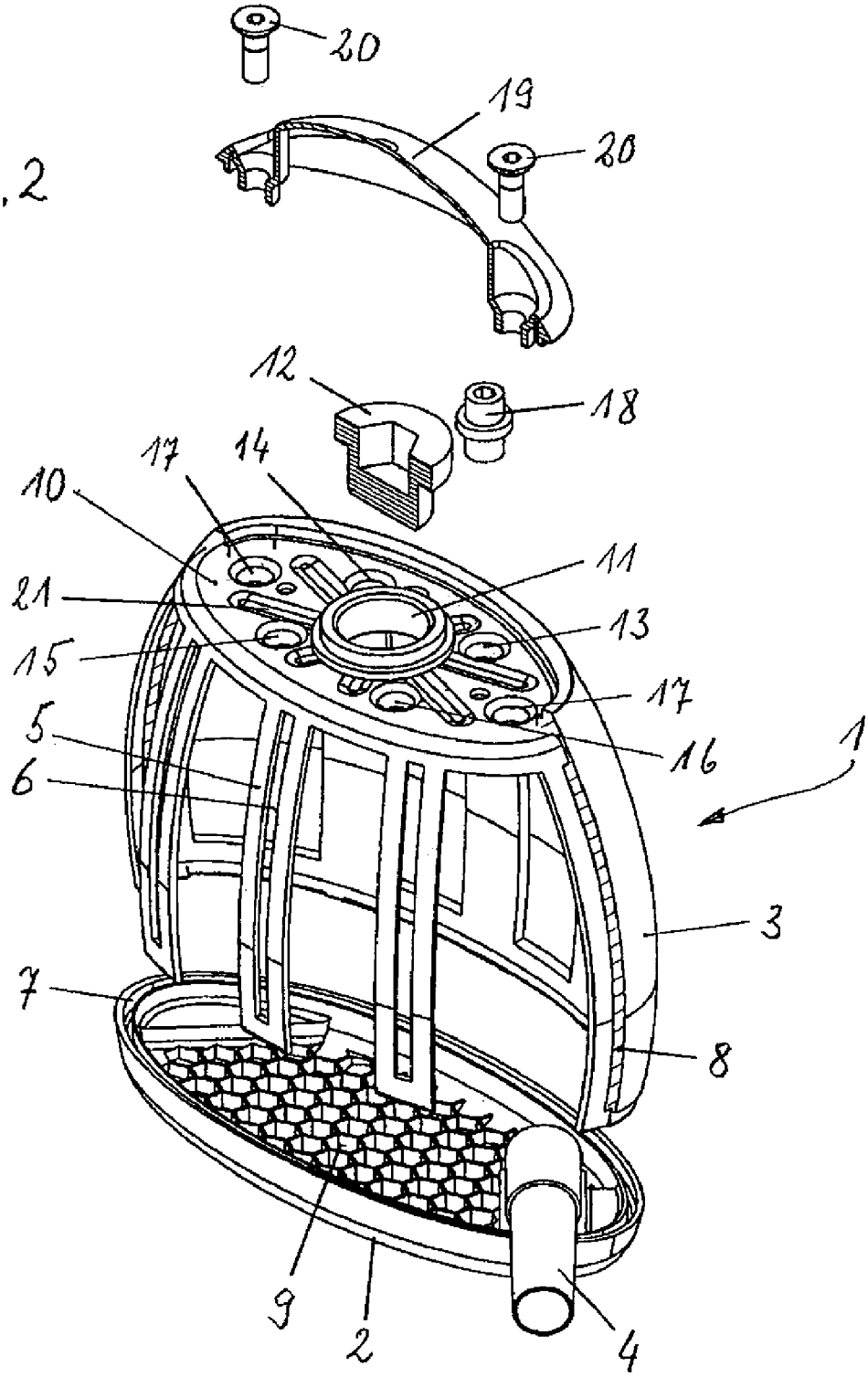

FIG. 1 is a schematic perspective view of a club head in accordance with the invention; and FIG. 2 is an exploded representation in partly broken open and sectioned form of an embodiment of a club head in accordance with the invention.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 shows, in a schematic oblique view, a club head 1 in accordance with the invention having a striking plate 2 and a main body 3. Main body 3 is connected to this striking plate 2 and is made as a hollow body. A shaft connection part 4 of main body 3 is adjacent to the striking plate 2. Complementary to the aerodynamically designed outer contour of the main body 3, a cover part 19 is provided which can be affixed to the main body 3 and via which weight elements fixable in the main body 3 are accessible.

FIG. 2 shows the detailed structure of a club head 1 such as can be seen in the outside view in FIG. 1.

The club head 1 comprises an oval striking plate 2. Striking plate 2 is stiff with respect to bending. Preferably, striking plate 2 is made of titanium and is fixedly connected to main body 3. Preferably, striking plate 2 is adhesively bonded and additionally pinned to the main body 3. The striking plate 2, which is preferably made in a forging process, and is provided at the rear with bead patterns. Preferably, the bead pattern is in the form of a honeycomb structure 9, for the purpose of the desired achieving of a high bending stiffness. Moreover, a shaft connection part 4 is provided at the rear at this striking plate 2.

The honeycomb structure 9 at the rear of the striking plate 2 extends over the main region of the striking plate. However, honeycomb pattern 9 does not have to be provided in the narrower oval edge regions where the shaft connection part 4 is located and where a weight-balancing wall reinforcement can be provided in an oppositely disposed manner.

The main body 3 can be made both as a full shell part and in an aspect analog to a type of metal spider of hardened steel, as is shown in FIG. 2. The main body 3 can consist fully of plastic reinforced with carbon fibers. Main body 3 also includes the support surface 10 furthermore preferably consisting of a hardened metal plate stiff with respect to bending. In some embodiments, the main body 3 may be made in the manner of a metal spider with flat braces 5 made in a throughgoing curved manner and with slits 21 optionally provided therein. In these embodiments, this metal spider is preferably in turn jacketed with a plastic reinforced with carbon fibers. The carbon fibers are present in the respective plastic either in crossed position or in tangled position.

The free end of the main body 3 engages into a peripheral fixing groove 7 of the striking plate 2 and is adhesively bonded. In addition to being adhesively bonded to striking plate 2, main body 3 may additionally pinned to the striking plate 2.

In accordance with an embodiment variant, it is also possible to connect the individual flat braces 5 to one another at their free ends, with the peripheral connection region then being introduced into the peripheral fixing groove 7 of the striking plate 2 and being fixed therein.

The ovally designed support surface 10 is aligned with respect to its main axes to the likewise oval striking plate 2. However, ovally designed support surface 10 has a smaller surface than the striking plate 2. Ovally designed support surface 10 includes a central receiver 11 to which a central weight 12 can be affixed. Preferably, central weight 12 is particular screwed onto central receiver 11. However, other methods of affixing central weight 12 may be used. Central weights 12 of different weight can be used to influence the stroke behavior. The respective weight of the central weight 12 is preferably larger than the weight of a golf ball. Still more preferably, central weight 12 is in a range from about one-third of the weight of striking plate 2 to about two-thirds of the weight of the striking plate 2.

The support surface 10 is provided with a plurality of support surface beads 21 for the stiffening and the simultaneous saving of weight. These support surface beads 21 extending substantially radially from a center of the surface.

The support surface 10 furthermore has, in the embodiment shown, four receivers 13, 14, 15, 16 for balance weights 18 which can in turn be fixed or screwed in these receivers.

It is possible by means of these balance weights 18, which can be selected differently with respect to their weight, to influence the stroke behavior and to adapt it to individual needs of the user. The receivers 13, 14, 15, 16 for the balance weights 18 are preferably located at both sides of the longitudinal axis of the oval support surface 10 and thus in the projection onto the striking plate 2 above and beneath the striking plate center.

The support surface 10 and weights fastened in it can be covered by a cover part 19. cover part 19 may be affixed to support surface 10 by means of screws 20 which interact with threads 17 in the support surface 10 so that the closed outer contour in accordance with FIG. 1 results when the cover part 19 is attached.

It is generally also possible to introduce a damping material having a low weight, in particular a foam-like material, i.e. a material including a high portion of air bubbles, into the hollow space of the main body 3.

The description of the invention is merely exemplary in nature and, thus, variations that do not depart from the gist of the invention are intended to be within the scope of the invention. Such variations are not to be regarded as a departure from the spirit and scope of the invention.

REFERENCE NUMBER LIST

1 club head
2 striking plate
3 main body
4 shaft connection part
5 flat brace
6 slit
7 peripheral fixing groove
8 plastic jacket
9 honeycomb structure
10 support surface
11 central receiver
12 central weight
13 receiver
14 receiver
15 receiver

16 receiver
17 screw hole
18 balance weight
19 cover part
20 fastening screw
21 support surface beads

What is claimed is:

1. A golf club comprising a club head (1) having a striking plate (2) which club head (1) is fastened to a club shaft end and whose striking plate (2) is connected at its edge side to a main body (3) made as a hollow body, wherein a central weight is arranged in the rearward region of the main body wherein that the main body (3) connected to the striking plate (2) comprises a metallic support surface (10) being spaced from the striking plate and being positioned at least substantially centrally in an axial protection with respect to the striking plate in the most rearward region of the main body (3) in that the metallic support surface (10) is designed for the rear side fixing of said central weight (12) in that the striking plate (2), the main body (3) and the support surface (10) are made stiff with respect to bending and in that the support surface (10) and the central weight (12) fixed to it are covered by a cover part (19) completing the dome-shaped outer contour of the main body (3) and being fastenable to the support surface (10).

2. A golf club in accordance with claim 1, wherein the central weight (12) is screwed to the main body (3).

3. A golf club in accordance with claim 1, wherein the weight of the central weight (12) is greater than the weight of a golf ball.

4. A golf club in accordance with claim 1, wherein a weight of the central weight (12) lies in a range from approximately one-third of the weight of the striking plate to approximately two-thirds of the weight of the striking plate (2).

5. A golf club in accordance with claim 1, wherein the striking plate (2) comprises titanium and is made stiff with respect to bending.

6. A golf club in accordance with claim 1, wherein the striking plate (2) is forged and is provided with one of integral stiffening contours (9) and bead patterns at a rear of the striking plate.

7. A golf club in accordance with claim 1, wherein the main body (3) comprises a dome-shaped shell part that is outwardly arched in a throughgoing manner and that merges, remote from the striking plate (2), into the support surface (10), which is planar and smaller than the surface of the striking plate (2).

8. A golf club in accordance with claim 1, wherein the main body (3) comprises at least one material selected from the group consisting of plastic, plastic reinforced by carbon fibers, metal and a composite of metal and plastic.

9. A golf club in accordance with claim 1, wherein the main body (3) comprises a plurality of mutually spaced apart flat braces (5) that are curved in accordance with a contour of the main body, at least in a region of the extent of the main body between the support surface (10) and the striking plate (2).

10. A golf club in accordance with claim 9, wherein the flat braces (5) extend from the support surface (10) up to the striking plate (2), engage into a peripheral fixing groove (7) of the striking plate and are adhesively bonded and pinned to the striking plate (2) in the fixing groove (7).

11. A golf club in accordance with claim 9, wherein the mutual spacing of the flat braces (5) over the periphery of the main body (3) is selected to be different.

12. A golf club in accordance with claim 1, wherein the main body (3) comprises hardened steel in the form of a plurality of flat braces, and is overmolded with plastic.

13. A golf club in accordance with claim 1, wherein the main body (3) comprises one of plastic reinforced with carbon fibers and a hollow body which has a jacket of plastic reinforced with carbon fibers.

14. A golf club in accordance with claim 13, wherein the carbon fibers are arranged in the plastic in a crossed position or a tangled position.

15. A golf club in accordance with claim 1, wherein a central receiver (11) in the support surface (10) is made of hardened steel and is made for the fixing of central weight (12) of different weight.

16. A golf club in accordance with claim 1, wherein the support surface (10) is provided with reinforcement beads (21), which extend substantially radially with respect to the central weight (12).

17. A golf club in accordance with claim 1, wherein a plurality of radially spaced apart receivers (13, 14, 15, 16) for said receiver (11) of the central weight (12) are provided in the support surface (10) for balance weights (18).

18. A golf club in accordance with claim 17, wherein the receivers (13, 14, 15, 16) of the support surface (10) comprise threaded holes into which at least one of central weights and balance weights can be screwed.

19. A golf club in accordance with claim 17, wherein the receivers (13, 14, 15, 16) for the balance weights (18) are arranged symmetrically with respect to main axes of the support surface (10), wherein the support surface is oval, and the receivers are positioned above and beneath the striking plate center in pairs in the projection onto the striking plate (2).

20. A golf club comprising a club head which is fastened to a club shaft end and whose striking plate is connected at its edge side to a main body made as a hollow body, wherein:

a central weight is arranged opposite to the striking plate in the rearward region of the main body, said main body connected to the striking plate comprises a metallic support surface being spaced from the striking plate and being positioned at least substantially centrally in an axial projection with respect to the striking plate in the rearward region of said main body, said main body comprising a dome-shaped shell part which is outwardly arched in a throughgoing manner and that merges, remote from the striking plate, into the support surface, in that the metallic support surface is planar and smaller than the surface of the striking plate, and the metallic support surface (10) is designed for the rear side fixing of said central weight; and the striking plate, the main body and the support surface are made stiff with respect to bending, and the support surface and the central weight fixed to it are covered by a cover part completing the dome-shaped outer contour of said main body and being fastenable to the support surface.

* * * * *